US009530599B2

(12) United States Patent
Yamagata et al.

(10) Patent No.: US 9,530,599 B2
(45) Date of Patent: Dec. 27, 2016

(54) ELECTROMAGNETIC RELAY

(71) Applicant: Panasonic Intellectual Property Management Co., Ltd., Osaka (JP)

(72) Inventors: Katsutoshi Yamagata, Hokkaido (JP); Tsukasa Nishimura, Hokkaido (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/073,629

(22) Filed: Mar. 17, 2016

(65) Prior Publication Data

US 2016/0300679 A1 Oct. 13, 2016

(30) Foreign Application Priority Data

Apr. 7, 2015 (JP) ..... 2015-078644

(51) Int. Cl.
*H01H 51/22* (2006.01)
*H01H 50/56* (2006.01)

(52) U.S. Cl.
CPC ..... *H01H 50/56* (2013.01); *H01H 2205/002* (2013.01)

(58) Field of Classification Search
CPC .. H01H 50/56; H01H 2205/002; H01H 51/06; H01H 50/54
USPC ..... 335/128–130
See application file for complete search history.

(56) References Cited

FOREIGN PATENT DOCUMENTS

JP 2-110154 U 9/1990

*Primary Examiner* — Bernard Rojas
(74) *Attorney, Agent, or Firm* — Greenblum & Bernstein, P.L.C.

(57) ABSTRACT

An electromagnetic relay includes an electromagnet block, a pair of fixed contacts, a movable spring, and a stopper. The electromagnet block includes an exciter coil and an armature. The movable spring includes a fixed portion and a movable portion. The fixed portion is fixed to the electromagnet block. The movable portion contacts fixed contact and is separated from the fixed contacts in response to turning on and off of an energizing of the exciter coil. The stopper configured to restrict a movement of the movable portion. The armature is fixed to the movable portion and is displaced unitarily with the movable portion. The movable spring is configured to, upon turning on the energizing of the exciter coil, cause the movable portion to move, by magnetic force, in an approaching direction in which the movable portion approaches the fixed contacts with the fixed portion functioning as a fulcrum, and contact the fixed connection portions. The movable spring is configured to, upon turning off the energizing of the exciter coil, cause the movable portion to be separated, by restoring force, from the fixed contacts in a separating direction in which the movable portion is separated from the fixed contacts. The stopper is configured to, upon turning on the energizing of the exciter coil, contact the movable portion and reduce a moving speed of the movable portion in the approaching direction before the movable portion contacts the fixed contacts. The stopper is configured to, upon turning off the energizing of the exciter coil, contact the armature and reduce the moving speed of the movable portion in the separating direction.

5 Claims, 13 Drawing Sheets

ELECTROMAGNETIC RELAY

TECHNICAL FIELD

The present invention relates to a hinge-type electromagnetic relay.

BACKGROUND ART

Japanese Utility Model Laid-Open Publication No. 2-110154 discloses an electromagnetic relay with a configuration regulating a movement of a movable spring after a movable contact of the movable spring is separated from a fixed contact The conventional electromagnetic relay disclosed in the above document regulates the movement of the movable spring with a stopper that is formed unitarily with a flange of a bobbin. The stopper is made of resin. The stopper is fixed to the bobbin. In the electromagnetic relay, the movement of the movable spring is regulated by the movable spring contacting the stopper.

In the electromagnetic relay, a large collision noise is generated when the movable spring collides against the stopper.

SUMMARY

An electromagnetic relay includes an electromagnet block, a pair of fixed contacts, a movable spring, and a stopper. The electromagnet block includes an exciter coil and an armature. The movable spring includes a fixed portion and a movable portion. The fixed portion is fixed to the electromagnet block. The movable portion contacts fixed contact and is separated from the fixed contacts in response to turning on and off of an energizing of the exciter coil. The stopper configured to restrict a movement of the movable portion. The armature is fixed to the movable portion and is displaced unitarily with the movable portion. The movable spring is configured to, upon turning on the energizing of the exciter coil, cause the movable portion to move, by magnetic force, in an approaching direction in which the movable portion approaches the fixed contacts with the fixed portion functioning as a fulcrum, and contact the fixed connection portions. The movable spring is configured to, upon turning off the energizing of the exciter coil, cause the movable portion to be separated, by restoring force, from the fixed contacts in a separating direction in which the movable portion is separated from the fixed contacts. The stopper is configured to, upon turning on the energizing of the exciter coil, contact the movable portion and reduce a moving speed of the movable portion in the approaching direction before the movable portion contacts the fixed contacts. The stopper is configured to, upon turning off the energizing of the exciter coil, contact the armature and reduce the moving speed of the movable portion in the separating direction.

This electromagnetic relay reduces the collision noise generated when the movable spring collides against the stopper.

DETAILED DESCRIPTION OF PREFERRED EMBODIMENT

Figure 1:
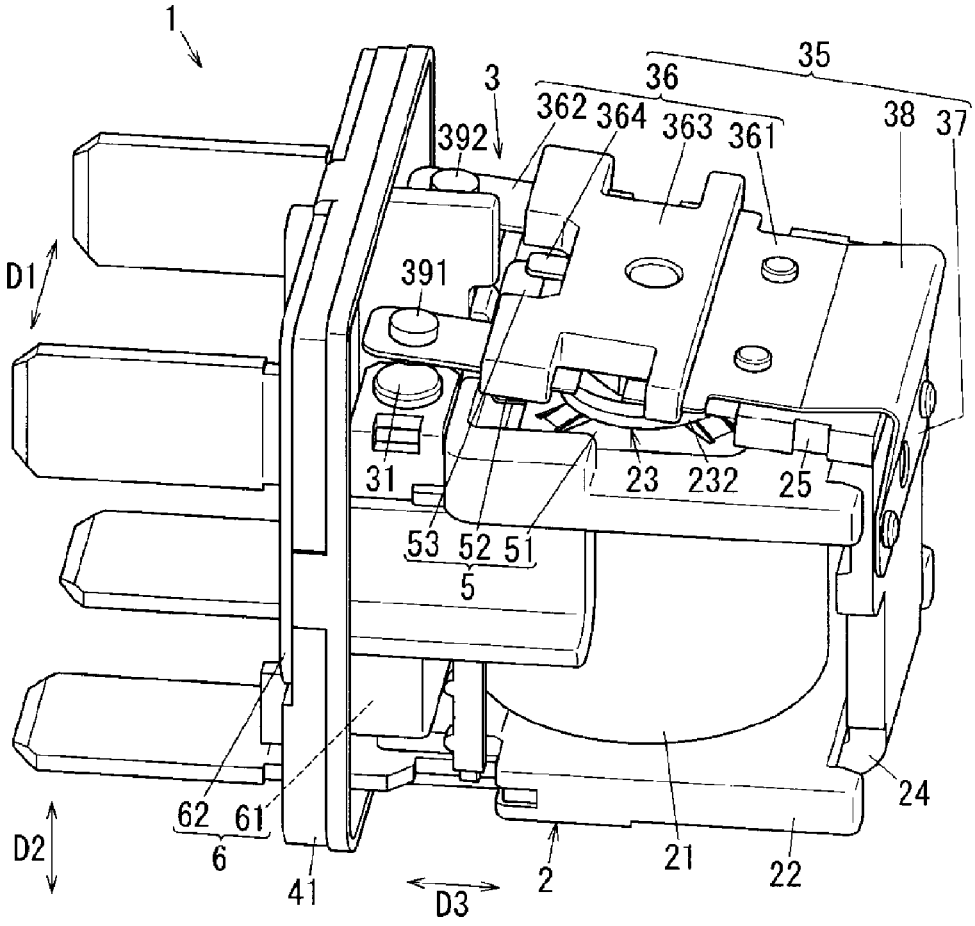
FIG. 1 is a perspective view of an electromagnetic relay according to an exemplary embodiment.
Figure 2:
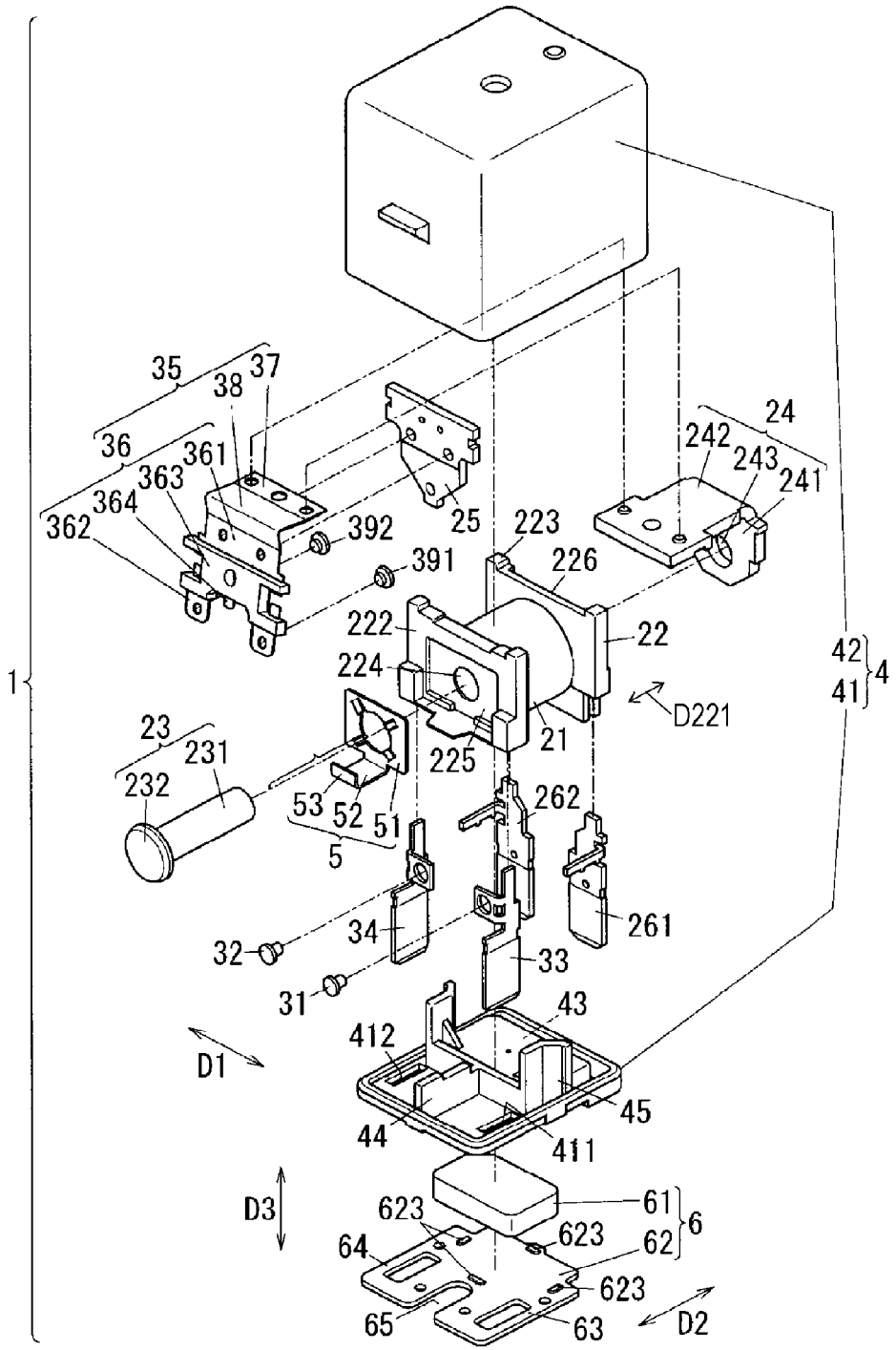
FIG. 2 is an exploded perspective view of the electromagnetic relay according to the embodiment.

FIG. 1 is a perspective view of electromagnetic relay 1 according to an exemplary embodiment. FIG. 2 is an exploded perspective view of electromagnetic relay 1. Electromagnetic relay 1 includes electromagnet block 2, contact block 3, case 4, stopper 5, and arc-extinguishing mechanism 6. In FIG. 1, direction D1, direction D2 perpendicular to direction D1, and direction D3 perpendicular to directions D1 and D2 are defined.

Electromagnet block 2 includes exciter coil 21, bobbin 22, core 23, yoke 24, armature 25, and pair of coil terminals 261 and 262, as illustrated in FIG. 2.

Figure 3:
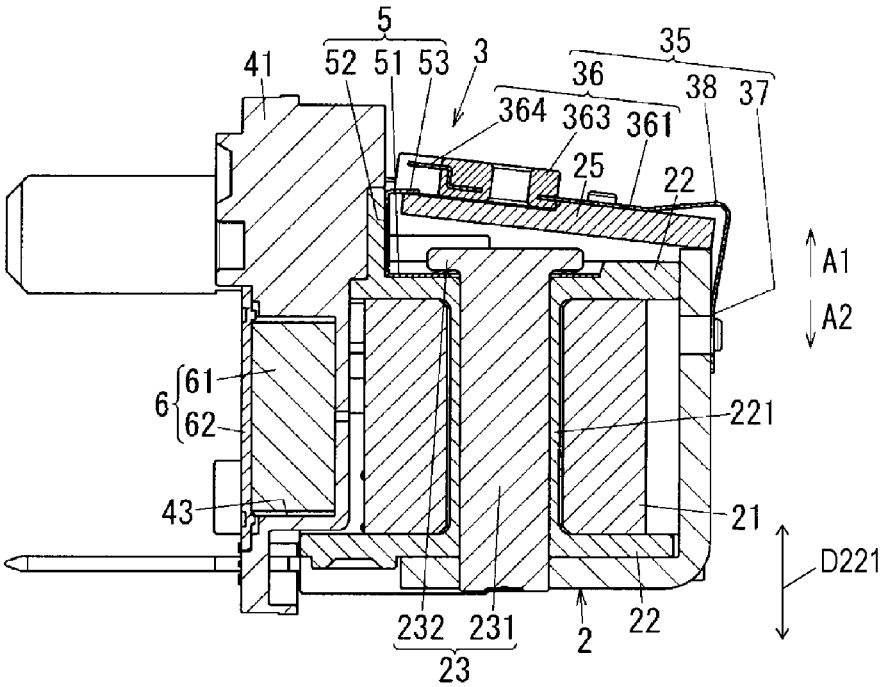
FIG. 3 is a sectional view of the electromagnetic relay according to the embodiment.

FIG. 3 is a sectional view of electromagnetic relay 1. Bobbin 22 includes tubular portion 221 and pair of flanges 222 and 223. Tubular portion 221 has therein insertion hole 224 extending in axial direction D221. Tubular portion 221 has a hollow cylindrical shape. Pair of flanges 222 and 223 have, e.g. substantially rectangular plate shapes, and are provided at both ends of tubular portion 221 in axial direction D221. Tubular portion 221 and pair of flanges 222 and 223 are unitarily made of insulating material, such as resin. Exciter coil 21 is wound on tubular portion 221 between flanges 222 and 223 of bobbin 22. Recess 225 is formed substantially a center of tubular portion 221.

Core 23 is inserted into insertion hole 224 of bobbin 22 and faces armature 25. Core 23 includes shaft portion 231 and flange 232. Shaft portion 231 has a columnar shape, and more specifically, a circular columnar shape extending slenderly. Flange 232 is provided at one end of shaft portion 231. Shaft portion 231 and flange 232 are unitarily made of magnetic material.

Yoke 24 includes pieces 241 and 242 and has substantially an L shape. Pieces 241 and 242 are unitarily made of magnetic material. Piece 241 is fitted into recess 226 provided in flange 223 of bobbin 22. Insertion hole 243 is formed in piece 241. Core 23 is inserted into insertion hole 243. Piece 242 extends in a direction perpendicular to piece 241 from one end of piece 241 to form the L shape. Piece 242 extends along axial direction D221 of tubular portion 221 of bobbin 22.

Armature 25 is fixed to movable portion 36 of movable spring 35 and is displaced unitarily with movable portion 36. More specifically, armature 25 is fixed to movable portion 36 and arranged to face core 23. Armature 25 is made of magnetic material and has a flat plate shape extending slenderly. One end of armature 25 contacts piece 242 of yoke 24.

Each of pair of coil terminals 261 and 262 is made of conductive material, such as copper, and has a plate shape extending slenderly. Both ends of exciter coil 21 are respectively wound on coil terminals 261 and 262, and are connected by, e.g. soldering.

Contact block 3 includes pair of fixed contacts 31 and 32, pair of main terminals 33 and 34, and movable spring 35.

Fixed contact 31 is fixed to main terminal 33 while fixed contact 32 is fixed to main terminal 34. Main terminals 33 and 34 are made of conductive material, such as copper.

Movable spring 35 is configured to contact fixed contacts 31 and 32 and to be separated from fixed contacts 31 and 32 in response to turning on and off of energizing of exciter coil 21. Movable spring 35 includes movable portion 36, fixed portion 37, and restoring spring 38. Movable spring 35 has substantially an L shape.

Movable portion 36 is configured to contact fixed contacts 31 and 32 and be separated from fixed contacts 31 and 32 in response to turning on and off of energizing of exciter coil 21. More specifically, movable portion 36 is made of conductive material, such as copper. Movable portion 36 includes base portion 361, pressurizing portion 362, and molded portion 363. Movable portion 36 further includes protrusion 364. Parts of movable portion 36 other than molded portion 363 are made of metal. Molded portion 363 is made of insulating material, such as resin. Armature 25 is fixed to a surface of movable portion 36.

Pressurizing portion 362 includes pair of movable contacts 391 and 392 and deforms upon turning on the energizing of exciter coil 21. Fixed contacts 31 and 32 are arranged in direction D1. Movable contact 391 is provided at a position facing fixed contact 31 while movable contact 392 is provided at a position facing fixed contact 32. Movable contact 391 contacts fixed contact 31 and is separated from fixed contact 31. Movable contact 392 contacts fixed contact 32 and is separated from fixed contact 32.

Protrusion 364 is provided between movable contacts 391 and 392. More specifically, protrusion 364 projects from molded portion 363 between movable contacts 391 and 392. Protrusion 364 contacts stopper 5 upon turning on the energizing of exciter coil 21. Protrusion 364 preferably has elasticity. Therefore, a ratio a width of protrusion 364 in a direction perpendicular to a protruding length of protrusion 364 from molded portion 363 to the projecting length of protrusion 364 from molded portion 363 is preferably small.

Fixed portion 37 is fixed to electromagnet block 2. More specifically, fixed portion 37 is fixed to piece 242 of yoke 24 with, e.g. a screw. Movable spring 35 is thus fixed to yoke 24.

Movable spring 35 is configured to cause movable portion 36 to deform with fixed portion 37 functioning as a fulcrum and contacts fixed contacts 31 and 32 by armature 25 suctioned toward core 23 due to a magnetic force of exciter coil 21 upon turning on the energizing of exciter coil 21. Then, movable portion 36 is separated from fixed contacts 31 and 32 by a restoring force (elastic force) of movable spring 35 upon turning off the energizing of exciter coil 21.

Case 4 includes base 41 having substantially a rectangular flat plate shape and cover 42 having substantially a rectangular box shape. Cover 42 has a surface having an opening and covers base 41. Case 4 accommodates therein exciter coil 21, bobbin 22, core 23, yoke 24, armature 25, fixed contacts 31 and 32, and movable spring 35.

Base 41 has insertion hole 411 into which main terminal 33 is inserted, insertion hole 412 into which main terminal 34 is inserted, an insertion hole into which coil terminal 261 is inserted, and an insertion hole into which coil terminal 262 is inserted. Furthermore, base 41 has pocket 43 opening to the outside. More specifically, base 41 has pocket 43 provided at a position adjacent to exciter coil 21 in direction D3. Pocket 43 accommodates therein permanent magnet 61. Base 41 includes wall 44 provided between fixed contacts 31 and 32. Wall 44 isolates fixed contact 31 from fixed contact 32. Base 41 further includes support portion 45 that supports exciter coil 21.

Stopper 5 suppresses the movement of movable portion 36 of movable spring 35. More specifically, stopper 5 suppresses the movement of movable portion 36 of movable spring 35 after movable portion 36 (movable contacts 391 and 392) of movable spring 35 is separated from fixed contacts 31 and 32 upon turning off the energizing of exciter coil 21. Stopper 5 is made of metal. Stopper 5 is preferably made of the same metal as movable spring 35. Stopper 5 may not necessarily be made of the same metal, and may be made of different material. Stopper 5 is preferably made of non-magnetic material. Stopper 5 may not necessarily be made of non-magnetic material, and may be made of magnetic material.

Figure 4:
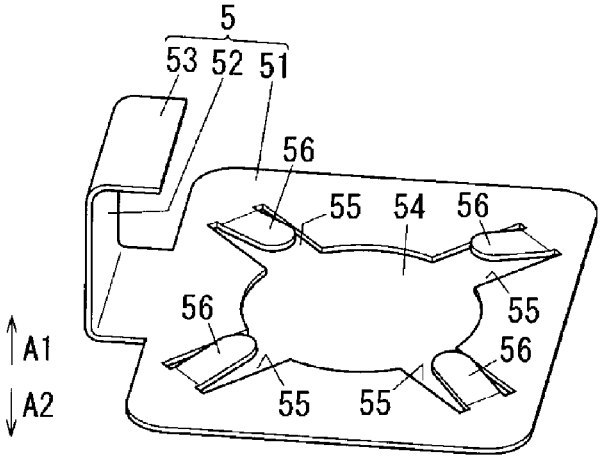
FIG. 4 is a perspective view of a stopper of the electromagnetic relay according to the embodiment.

FIG. 4 is a perspective view of stopper 5. Stopper 5 includes base portion 51, extending portion 52, and contact portion 53. Base portion 51, extending portion 52, and contact portion 53 are unitarily formed.

Base portion 51 is fixed to electromagnet block 2. More specifically, base portion 51 is fixed to bobbin 22. Base portion 51 has insertion hole 54 through which shaft portion 231 of core 23 is inserted. Base portion 51 is fitted into recess 225 formed substantially in the center of flange 222 of bobbin 22 and is pinched and fixed with flange 232 of core 23 and bobbin 22 while shaft portion 231 of core 23 is inserted into through-hole 54. Furthermore, base portion 51 has four cut-outs 55 provided at a periphery of through-hole 54. Base portion 51 includes four contact pieces 56 provided in four cut-outs 55, respectively. The tip end of each contact piece 56 inclines to be closer to flange 232 of core 23 than the base. This structure strongly fix base portion 51 while base portion 51 is pinched with flange 232 of core 23 and bobbin 22.

Extending portion 52 extends from base portion 51. More specifically, extending portion 52 extends perpendicularly from base portion 51.

Contact portion 53 has elasticity and contacts armature 25 and movable portion 36 of movable spring 35. Contact portion 53 is provided at the tip end of extending portion 52. In stopper 5 illustrated in FIG. 4, contact portion 53 has a flat plate shape. Contact portion 53 projects from the tip end of extending portion 52 perpendicularly to extending portion 52. That is, contact portion 53 is substantially parallel with base portion 51.

Contact portion 53 contacts movable portion 36 upon turning on the energizing of exciter coil 21. Contact portion 53 contacts armature 25 upon turning off the energizing of exciter coil 21. When movable portion 36 contacts contact portion 53, contact portion 53 warps due to elasticity in separating direction A1 in which movable contacts 391 and 392 of movable portion 36 is separated from fixed contacts 31 and 32, respectively. That is, contact portion 53 has elasticity to warp in separating direction A1. Therefore, contact portion 53 reduces the moving amount per unit time of movable portion 36 of movable spring 35 in separating direction A1, namely the moving speed of movable portion 36 more than before movable portion 36 contacts contact portion 53. Contact portion 53 preferably contacts movable portion 36 of movable spring 35 and armature 25 at a position that is closer to the tip end of contact portion 53 than to the base end of contact portion 53 on the side of extending portion 52.

Figure 5:
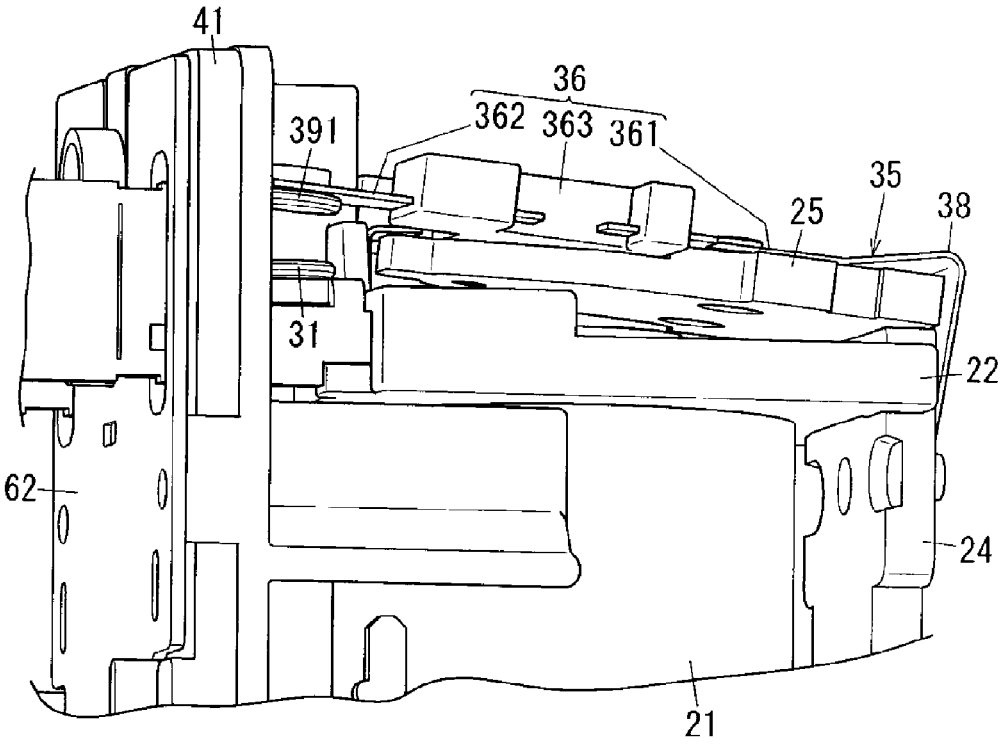
FIG. 5 is a perspective view of a main part of the electromagnetic relay according to the embodiment.
Figure 6:
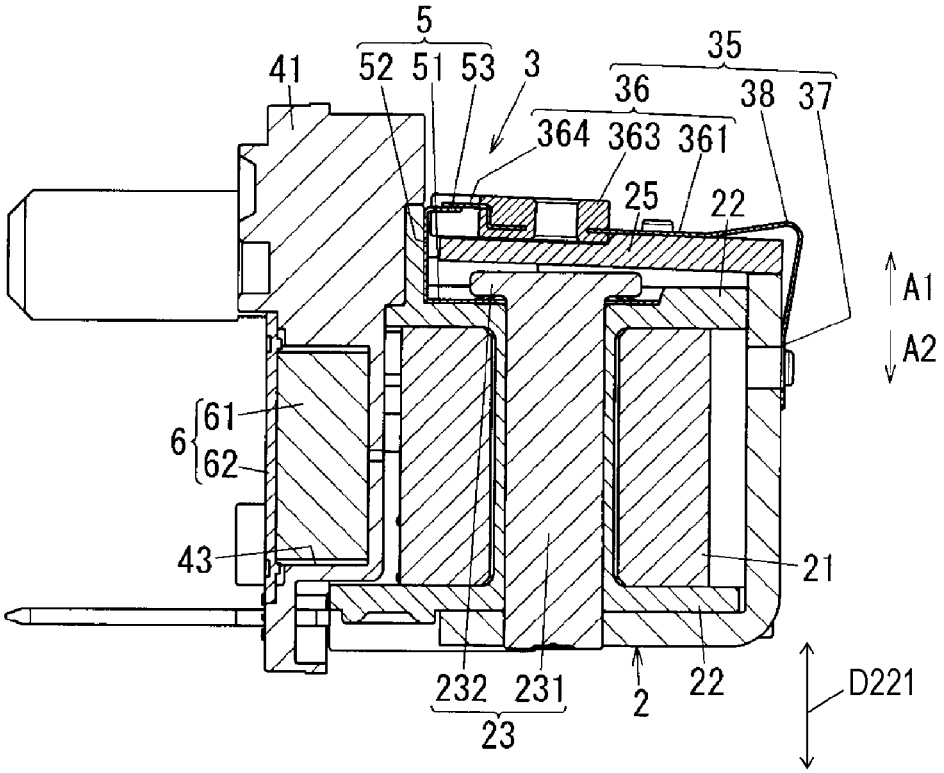
FIG. 6 is a sectional view of the electromagnetic relay according to the embodiment.
Figure 7:
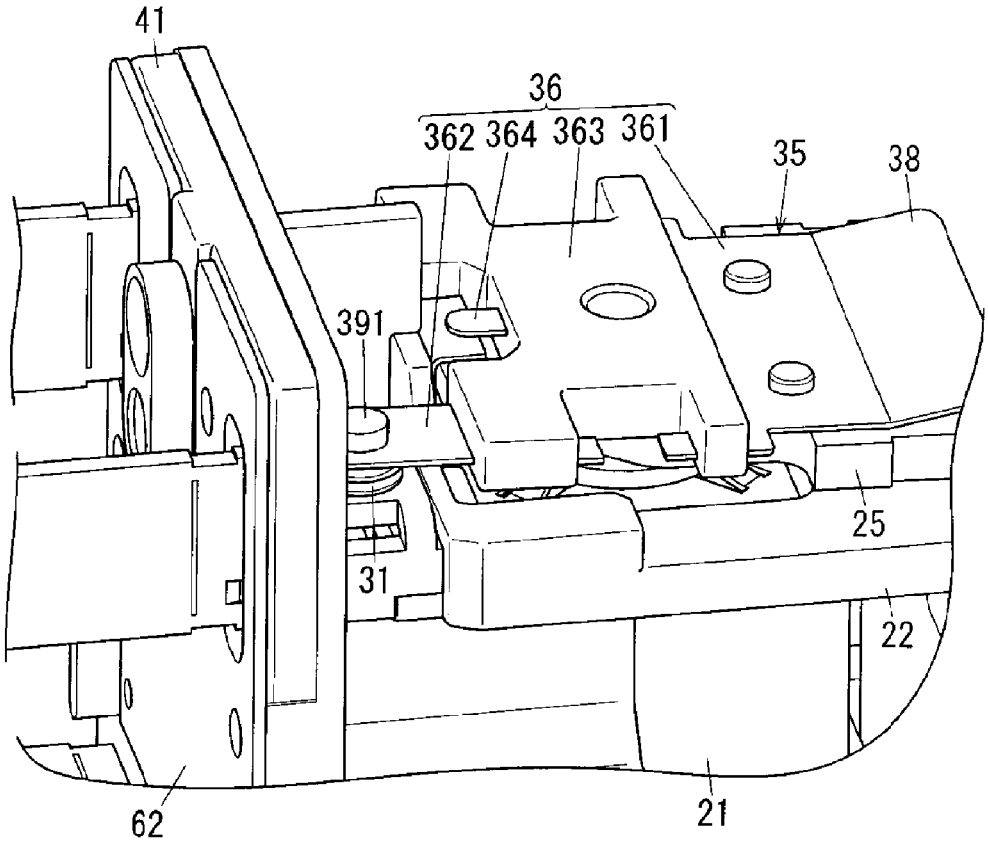
FIG. 7 is a perspective view of a main part of the electromagnetic relay according to the embodiment.

FIG. 5 is a perspective view of a main part of electromagnetic relay 1. FIGS. 6 and 7 are a sectional view of electromagnetic relay 1 and a perspective view of a main part of electromagnetic relay 1, respectively. Stopper 5 contacts armature 25 that is displaced unitarily with movable spring 35 as illustrated in FIGS. 3 and 5 upon turning off the energizing of exciter coil 21. Upon turning on the energizing of exciter coil 21, stopper 5 contacts protrusion 364 of movable portion 36 as illustrated in FIGS. 6 and 7 before movable contacts 391 and 392 of movable portion 36 of movable spring 35 contact fixed contacts 31 and 32. Stopper 5 reduces the moving speed of movable portion 36 in approaching direction A2. Approaching direction A2 is a direction in which movable portion 36 (pair of movable contacts 391 and 392) approaches pair of fixed contacts 31 and 32. After that, upon turning off the energizing of exciter coil 21, stopper 5 contacts armature 25 that is displaced unitarily with movable spring 35 as illustrated in FIGS. 3 and 5. Stopper 5 thus alleviates the movement of movable portion 36 in separating direction A1, that is, stopper 5 reduces the moving speed of movable portion 36 in separating direction A1.

Upon turning on the energizing of exciter coil 21, before movable portion 36 contacts fixed contacts 31 and 32, stopper 5 contacts movable portion 36, and reduces the moving speed of movable portion 36 in approaching direction A2 in which movable portion 36 approaches fixed contacts 31 and 32. Upon turning off the energizing of exciter coil 21, stopper 5 contacts armature 25 and alleviates the movement of the movable portion in separating direction A1 in which movable portion 36 is separated from fixed contacts 31 and 32, that is, stopper 5 reduces the moving speed of movable portion 36 in separating direction A1.

Figure 8:
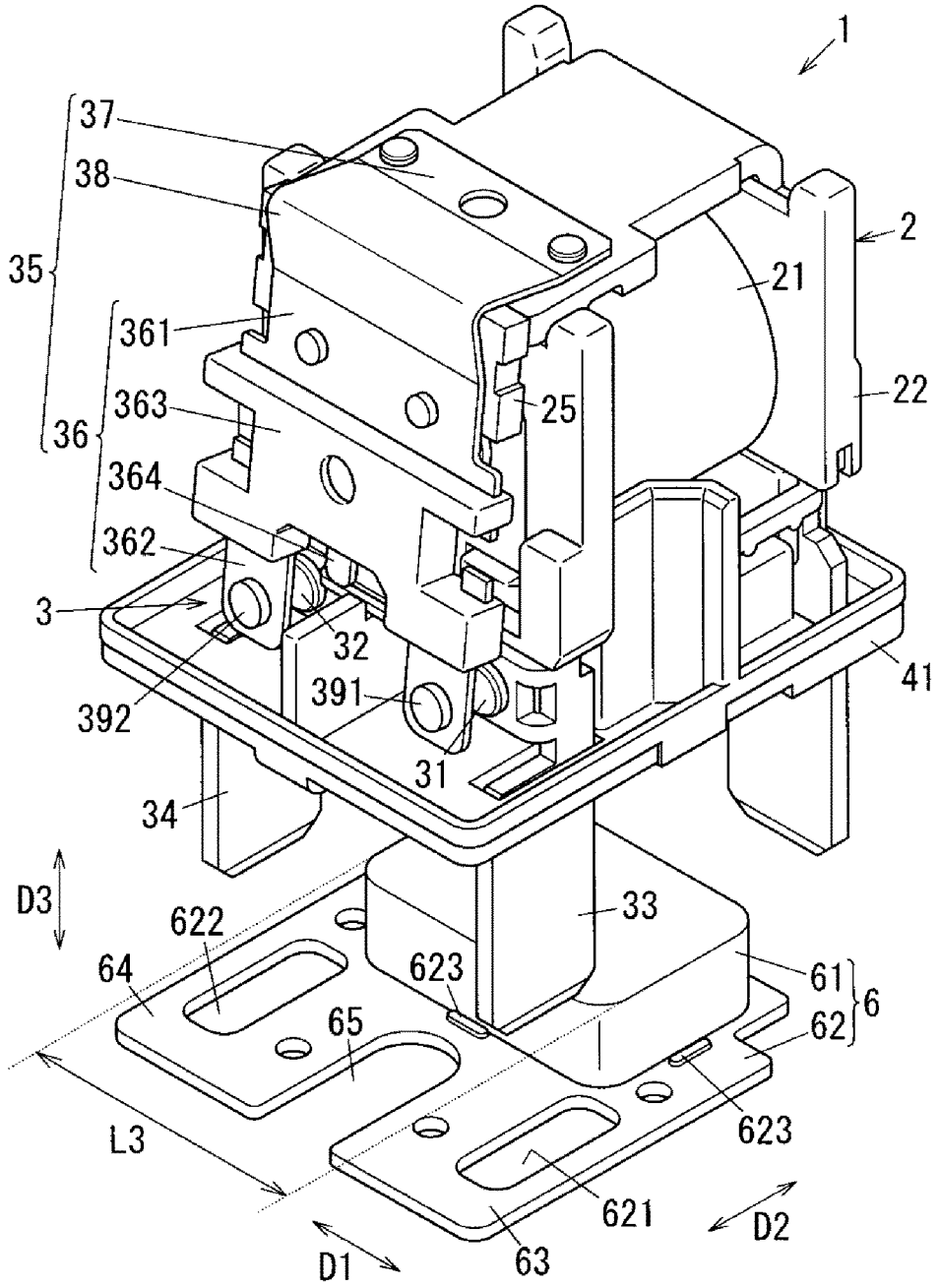
FIG. 8 is a partially exploded perspective view of the electromagnetic relay according to the embodiment.

FIG. 8 is a partially exploded perspective view of electromagnetic relay 1. Arc-extinguishing mechanism 6 includes permanent magnet 61 and yoke 62, as illustrated in FIG. 8.

Permanent magnet 61 is adjacent to pair of fixed contacts 31 and 32 in direction D2 perpendicular to direction D1 while the permanent magnet is accommodated in pocket 43 of base 41. Permanent magnet 61 is adjacent to exciter coil 21 in direction D3 perpendicular to directions D1 and D2. Permanent magnet 61 is made of, e.g. ferrite magnet. According to this embodiment, an N pole of permanent magnet 61 is arranged on the side of yoke 62 while an S pole is arranged on the side of exciter coil 21.

Figure 9:
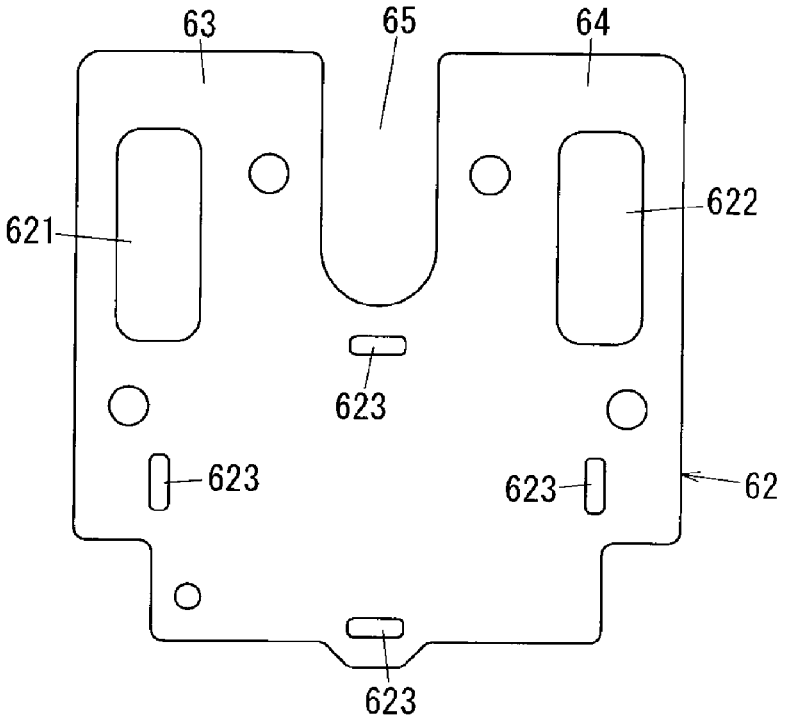
FIG. 9 is a perspective view of a yoke of the electromagnetic relay according to the embodiment.

FIG. 9 is a perspective view of yoke 62. Yoke 62 is made of material, such as iron-based material (e.g. a galvanized steel plate), with high magnetic permeability. Yoke 62 contacts permanent magnet 61. More specifically, yoke 62 is attached to permanent magnet 61 by magnetic force. Yoke 62 is adjacent to pair of fixed contacts 31 and 32 in direction D3 while contacting permanent magnet 61. Yoke 62 contacts an outer surface of case 4 while contacting permanent magnet 61. Yoke 62 has insertion hole 621 into which main terminal 33 is inserted and insertion hole 622 into which main terminal 34 is inserted, as illustrated in FIG. 9. Yoke 62 includes plural four in the embodiment) protrusions 623 for positioning permanent magnet 61.

Figure 10:
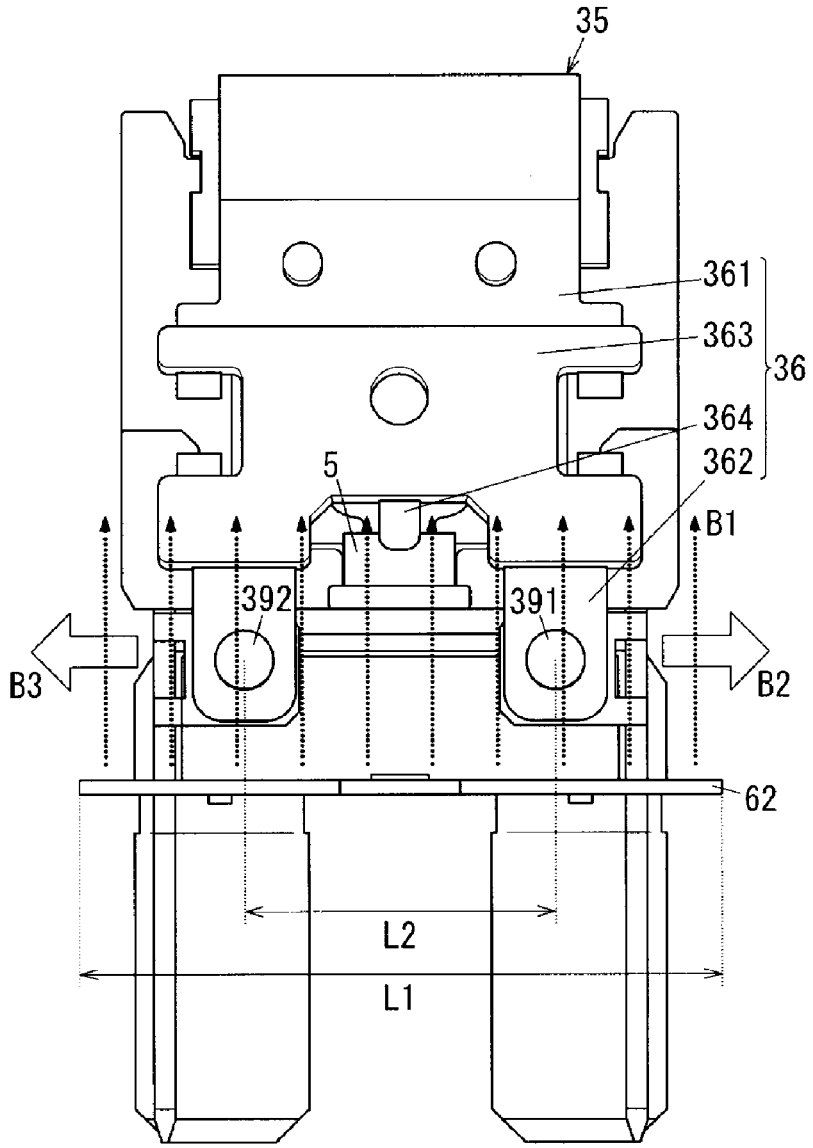
FIG. 10 is a perspective view of the electromagnetic relay according to the embodiment for illustrating a magnetic flux of the electromagnetic relay.
Figure 11:
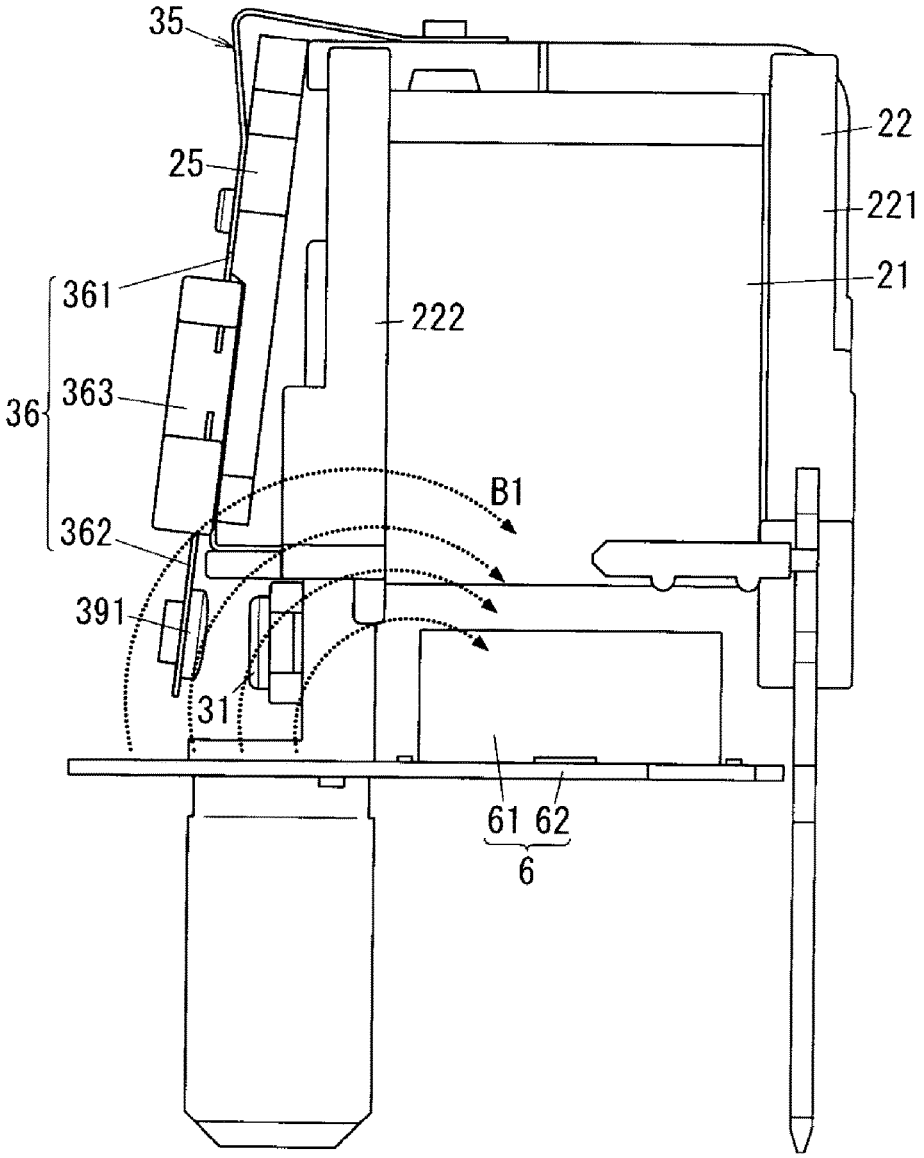
FIG. 11 is a perspective view of the electromagnetic relay according to the embodiment for illustrating a magnetic flux of the electromagnetic relay.

FIGS. 10 and 11 are perspective views of electromagnetic relay 1 for illustrating a magnetic flux. Arcs may be generated between movable contact 391 and fixed contact 31 and between movable contact 392 and fixed contact 32 when movable contacts 391 and 392 are separated from fixed contacts 31 and 32 upon turning off the energizing of exciter coil 21. At this moment, arc-extinguishing mechanism 6 (permanent magnet 61 and yoke 62) generates a magnetic flux in direction D3 around the contacts when viewed from direction D2 in which movable contacts 391 and 392 face fixed contacts 31 and 32, respectively, as illustrated in FIGS. 10 and 11. Based on the Fleming's left-hand rule, force acts on the arcs in direction D1 in which fixed contacts 31 and 32 are arranged. This force can stretch the arc generated between movable contact 391 and fixed contact 31 in direction B2, namely toward the outside. In addition, this can stretch the arc generated between movable contact 392 and fixed contact 32 in direction B3, namely toward the outside.

According to the embodiment, yoke 62 includes pair of adjacent portions 63 and 64 that are adjacent to pair of fixed contacts 31 and 32, respectively. Notch 65 is provided between pair of adjacent portions 63 and 64. This structure increases magnetic flux density around the contacts and stretches the arcs further toward the outside.

According to the embodiment, length L1 of yoke 62 (see FIG. 10) is longer than distance L2 between pair of fixed contacts 31 and 32 (see FIG. 10) in direction D1 in which pair of fixed contacts 31 and 32 are arranged. Furthermore, length L1 of yoke 62 is longer than length L3 of permanent magnet 61 (see FIG. 8) in direction D1. This configuration can stretch the arc to be longer and thereby extinguishes the arc in an early stage.

An operation of electromagnetic relay 1 according to the embodiment will be described with reference to FIGS. 3 to 7.

First, before turning on the energizing of exciter coil 21, armature 25 is separated from core 23 while movable spring 35 is attached to armature 25, and pair of movable contacts 391 and 392 are separated from pair of fixed contacts 31 and 32. Before turning on the energizing of exciter coil 21, armature 25 contacts stopper 5.

Then upon turning on the energizing of exciter coil 21, core 23 is magnetized, and armature 25 is attracted to flange 232 of core 23. Along with this attraction, the tip end of movable portion 36 of movable spring 35 provided with armature 25 is displaced. After that, pair of movable contacts 391 and 392 contact pair of fixed contacts 31 and 32, respectively. As a result, movable contacts 391 and 392 are connected electrically with fixed contacts 31 and 32, respectively.

Upon turning on the energizing of exciter coil 21, as described above, armature 25 is separated from contact portion 53 of stopper 5. After that, protrusion 364 of movable spring 35 contacts contact portion 53 of stopper 5 before movable contacts 391 and 392 contact fixed contacts 31 and 32. This configuration reduces the moving speed of movable spring 35.

Figure 12:
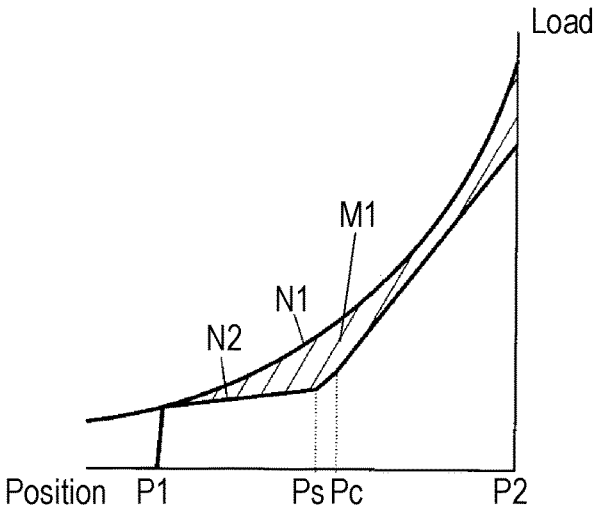
FIG. 12 shows the electromagnetic relay according to the embodiment for illustrating an operation of the electromagnetic relay according t.
Figure 13:
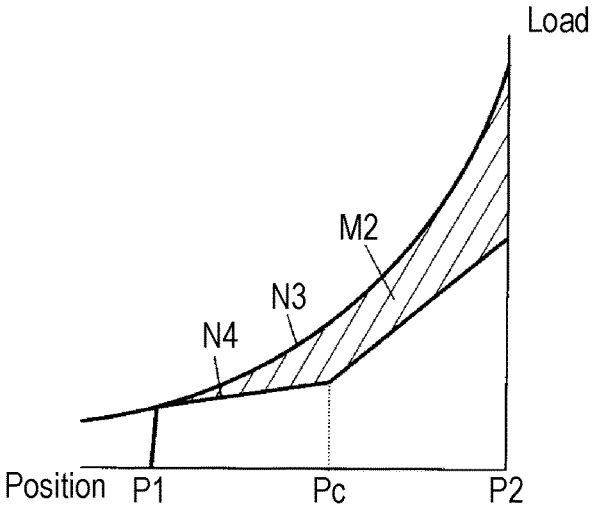
FIG. 13 shows a comparative example of an electromagnetic relay according for illustrating the comparative example.

FIG. 12 shows electromagnetic relay 1 for illustrating the operation of electromagnetic relay 1. FIG. 13 shows a comparative example of an electromagnetic relay which does not include stopper 5 for illustrating an operation of the comparative example. The comparative example of the electromagnetic relay has the same configuration as electromagnetic relay 1 according to the embodiment except that the comparative example of the electromagnetic relay does not include stopper 5. In FIGS. 12 and 13, the vertical axis represents a load applied on movable portion 36, and the horizontal axis represents a position of movable portion 36. FIG. 12, which illustrates properties of electromagnetic relay 1 according to the embodiment, represents suctioning force curve N1 that represents a load in approaching direction A2 applied to movable portion 36 and spring load curve N2 that represents a load in separating direction A1 applied to movable portion 36. FIG. 13 which represents properties of the comparative example of the electromagnetic relay represents suctioning force curve N3 that represents a load in approaching direction A2 applied to movable portion 36 and spring load curve N4 that represents a load in separating direction A1 applied to movable portion 36. In FIG. 12, movable portion 36 can be displaced within a range from position P1 to position P2. Position P1 is the position furthest from core 23. If movable portion 36 is displaced from position P1 and is then located at position Ps, movable portion 36 contacts stopper 5. If movable portion 36 is further displaced from position Ps and is then located at position Pc, movable contacts 391 and 392 contact fixed contacts 31 and 32, respectively. When movable portion 36 is located at position P2, movable portion 36 is suctioned by core 23 and contacts core 23. If movable portion 36 is similarly displaced from position P1 and is then located at position Pc shown in FIG. 13, movable contacts 391 and 392 contact fixed contacts 31 and 32, respectively. When movable portion 36 is located at position P2, movable portion 36 is suctioned by core 23 and contacts core 23. Since protrusion 364 of movable spring 35 contacts stopper 5 before movable portion 36 located at position P1 is displaced toward core 23 and is then located at position Pc and movable contacts 391 and 392 contact fixed contacts 31 and 32 in electromagnetic relay 1 according to the embodiment, contact collision energy M1 (see FIG. 12) of electromagnetic relay 1 according to the embodiment can be reduced more than contact collision energy M2 (see FIG. 13) of the comparative example of the electromagnetic relay which does not includes stopper 5. Contact collision energy M1 is an integral value of a difference between suctioning force curve N1 (see FIG. 12) and spring load curve N2 (see FIG. 12). Contact collision energy M2 is an integral value of a difference between suctioning force curve N3 (see FIG. 13) and spring load curve N4 (see FIG. 13).

In contrast, upon turning off the energizing of exciter coil 21, core 23 is demagnetized, armature 25 is separated from flange 232 of core 23 due to an elastic effect of movable spring 35, and movable portion 36 of movable spring 35 is displaced. Along with this displacement, pair of movable contacts 391 and 392 are separated away from pair of fixed contacts 31 and 32. As a result, pair of movable contacts 391 and 392 are electrically disconnected from pair of fixed contacts 31 and 32.

Upon turning off the energizing of exciter coil 21, as described above, protrusion 364 of movable spring 35 is separated from stopper 5 due to the elastic force of movable spring 35. Movable portion 36 of movable spring 35 is displaced. After that, armature 25 contacts contact portion 53 of stopper 5. At this moment, stopper 5 alleviates impact of movable spring 35 due to elasticity thereof.

In the conventional electromagnetic relay disclosed in Japanese Utility Model Laid-Open Publication No. 2-110154, since the movable spring vigorously collides against the stopper fixed to the bobbin and the stopper receives restoring force of the movable stopper, a large collision noise is generated when the movable spring collides against the stopper.

In electromagnetic relay 1 according to the embodiment, upon turning on the energizing of exciter coil 21, as described above, protrusion 364 of movable portion 36 contacts stopper 5, and stopper 5 reduces the moving speed of movable spring 35 before movable contacts 391 and 392 of movable portion 36 of movable spring 35 contact fixed contacts 31 and 32. That is, stopper 5 weakens the movement of movable spring 35. When movable contacts 391 and 392 of movable portion 36 of movable spring 35 contact fixed contacts 31 and 32, electromagnetic relay 1 according to the embodiment can reduce the contact collision energy more than the comparative example of the electromagnetic relay which does not include the stopper. As a result, a collision noise caused by movable contacts 391 and 392 of movable portion 36 of movable spring 35 contacting fixed contacts 31 and 32 is reduced.

Electromagnetic relay 1 according to the embodiment can reduce impact generated when armature 25 collides against core 23 by stopper 5 reducing the moving speed of movable spring 35. A collision noise caused by armature 25 colliding against core 23 is reduced.

Furthermore, electromagnetic relay 1 according to the embodiment can reduce contact bouncing by stopper 5 reducing the moving speed of movable spring 35. This configuration can reduce a wearing of the contacts due to an arc at the time of contact bouncing, thereby elongating an opening/closing life duration of the contacts.

Electromagnetic relay 1 according to the embodiment can reduce (absorb/alleviate) impact of armature 25 against stopper 5 at the time of returning by stopper 5 deforming with elasticity upon turning off the energizing of exciter coil 21, and stopper 5 contacts armature 25. Electromagnetic relay 1 according to the exemplary embodiment can reduce a collision noise caused by armature 25 colliding against stopper 5.

In electromagnetic relay 1 according to the embodiment, stopper 5 and movable portion 36 of movable spring 35 (including movable contacts 391 and 392) are made of metal. Stopper 5 and movable portion 36 (movable contacts 391 and 392) of movable spring 35, both of which are metal products, contact each other, abrasion powder is not easily generated in electromagnetic relay 1 than a relay including stopper 5 made of resin. Since the abrasion powder is metal powder in electromagnetic relay 1 according to the embodiment even if the abrasion powder is generated, electrical connection defect does not easily occur between each of movable contacts 391 and 392 of movable portion 36 of movable spring 35 and each of fixed contacts 31 and 32.

In electromagnetic relay 1 according to the embodiment, the same portion (contact portion 53) of stopper 5 contacts movable spring 35 or armature 25 both when exciter coil 21 is energized and when exciter coil 21 is not energized. This configuration can easily configure stopper 5 in electromagnetic relay 1 than a stopper in which contact points are different. Electromagnetic relay 1 according to the embodiment can reduce the number of parts as compared with a case in which a part contacted by movable spring 35 upon turning on the energizing of exciter coil 21 is separately provided from a part contacted by armature 25 upon turning off the energizing of exciter coil 21.

Electromagnetic relay 1 according to the embodiment increases a magnetic flux density around the contacts and in an arc extinguished space by using yoke 62 even if permanent magnet 61 is installed at a position far from the contacts (fixed contacts 31 and 32 and movable contacts 391 and 392). This configuration enhances interruption ability without increasing the size of electromagnetic relay 1.

Electromagnetic relay 1 according to the invention can concentrate the magnetic flux around the contacts since notch 65 is provided in yoke 62 between adjacent portions 63 and 64 that are adjacent to fixed contacts 31 and 32, respectively. This configuration increases the magnetic flux density around the contact more than the electromagnetic relay in which a yoke does not have such a notch, thereby further enhancing the interruption ability, Electromagnetic relay 1 according to the embodiment can elongate an arc to be longer by setting length L1 of yoke 62 to be longer than distance L2 between pair of fixed contacts 31 and 32 in direction D1 in which pair of fixed contacts 31 and 32 are arranged, namely a direction in which the arc is elongated. In This configuration extinguishes the arc in an early stage, thereby further enhancing interruption ability.

Figure 14:
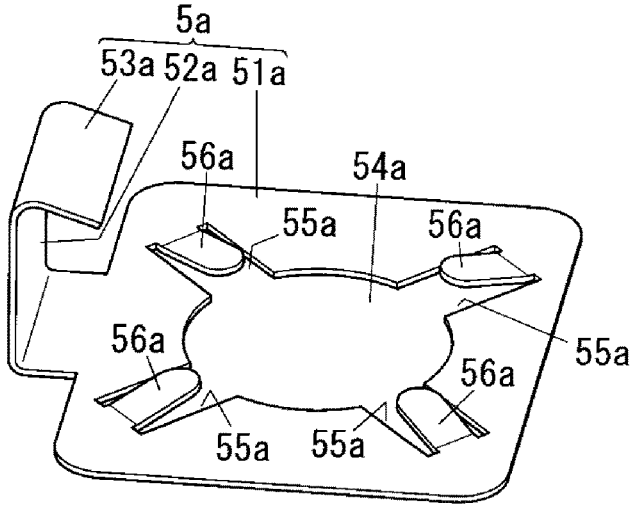
FIG. 14 is a perspective view of another stopper of the electromagnetic relay according to the embodiment.

FIG. 14 is a perspective view of another stopper 5*a* of electromagnetic relay 1 according to the embodiment. In FIG. 14, components identical to those of stopper 5 illustrated in FIG. 4 are denoted by the same reference numerals. Electromagnetic relay 1 according to the embodiment may include stopper 5*a* illustrated in FIG. 14 instead of stopper 5 illustrated in FIG. 4. Stopper 5*a* includes base portion 51*a*, extending portion 52*a*, and contact portion 53*a*. Base portion 51*a*, extending portion 52*a*, and contact portion 53*a* are unitarily formed. Base portion 51*a* has the same configuration as base portion 51 (see FIG. 4) of stopper 5. Through-hole 54*a*, cut-out 55*a*, and contact piece 56*a* are the same as through-hole 54, cut-out 55, and contact piece 56 (see FIG. 4) of stopper 5, respectively. Extending portion 52*a* has the same configuration as extending portion 52 (see FIG. 4) of stopper 5.

Contact portion 53*a* projects from a tip end of extending portion 52*a* to be angled by an angle less than 90 degrees with respect to extending portion 52*a*. That is, contact portion 53*a* is configured such that the tip end of contact portion 53*a* further extends toward base portion 51*a* as compared with a portion of contact portion 53*a* to the base portion. Contact portion 53*a* is the same as contact portion 53 (see FIG. 4) of stopper 5 other than the above structure.

Figure 15:
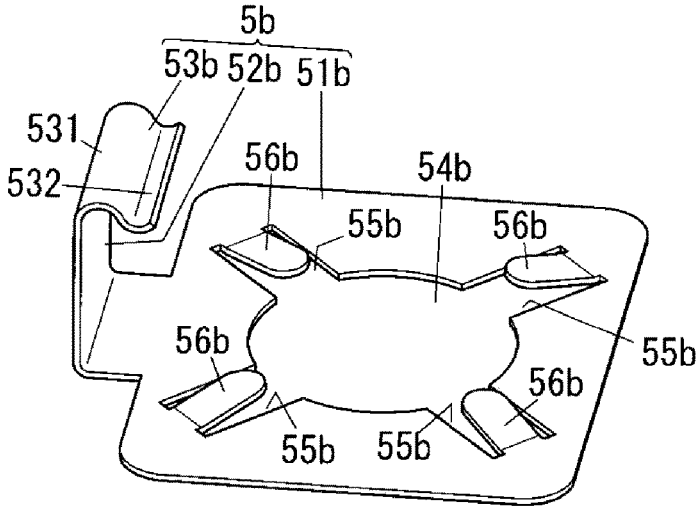
FIG. 15 is a perspective view of still another stopper of the electromagnetic relay according to the embodiment.

FIG. 15 is a perspective view of still another stopper 5*b* of electromagnetic relay 1 according to the embodiment. In FIG. 15, components identical to those of stopper 5 illustrated in FIG. 4 are denoted by the same reference numerals. Electromagnetic relay 1 according to the embodiment may be include stopper 5*b* illustrated in FIG. 15 instead of stopper 5 illustrated in FIG. 4. Stopper 5*b* includes base portion 51*b*, extending portion 52*b*, and contact portion 53*b*. Base portion 51*b*, extending portion 52*b*, and contact portion 53*b* are unitarily formed. Base portion 51*b* has the same configuration as base portion 51 (see FIG. 4) of stopper 5. Through-hole 54*b*, cut-out 55*b*, and contact piece 56*b* are the same as through-hole 54, cut-out 55, and contact piece 56 (see FIG. 4) of stopper 5, respectively. Extending portion 52*b* has the same configuration as extending portion 52 (see FIG. 4) of stopper 5.

Contact portion 53*b* has a curved plate shape. Specifically, contact portion 53*b* includes curved surfaces 531 and 532. Curved surface 531 extends from extending portion 52*b*. Curved surface 532 extends from cured surface 531. Curved surfaces 531 and 532 are unitarily formed. Curved surface 531 has the tip end of extending portion 52*b*. Curved surface 531 has a convex surface projecting in separating direction A1 in which movable contacts 391 and 392 of movable portion 36 is separated from fixed contacts 31 and 32. Curved surface 532 is provided at the tip end of curved surface 531. Curved surface 532 has a convex surface projecting in approaching direction A2 in which movable contacts 391 and 392 of movable portion 36 approaches fixed contacts 31 and 32. Contact portion 53*b* is the same as contact portion 53 (see FIG. 4) of stopper 5 other than the above structure.

Figure 16:
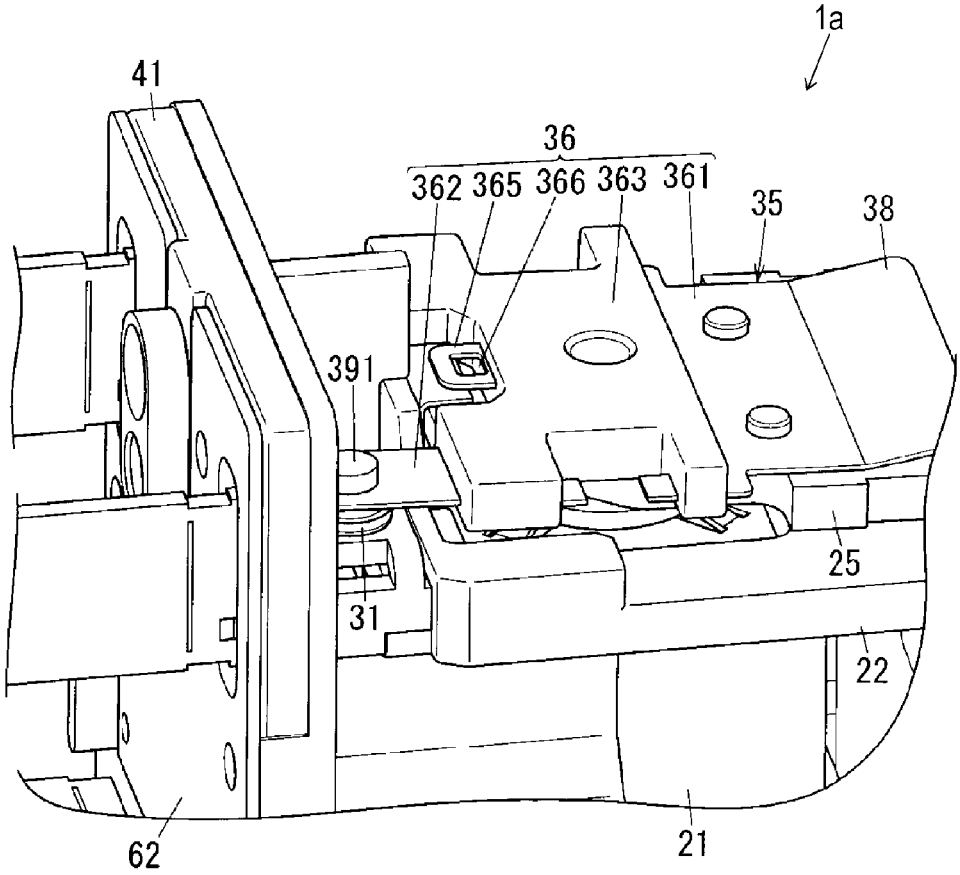
FIG. 16 is a perspective view of a main part of another electromagnetic relay according to the embodiment.

FIG. 16 is a perspective view of a main part of another electromagnetic relay 1*a* according to the embodiment. In FIG. 16, components identical to those of electromagnetic relay 1 illustrated in FIGS. 1 to 11 are denoted by the same reference numerals. Movable portion 36 of movable spring 35 of electromagnetic relay 1*a* includes protrusion 365 illustrated in FIG. 16 instead of protrusion 364 of movable portion 36 of movable spring 35 of electromagnetic relay 1.

Protrusion 365 is provided between pair of movable contacts 391 and 392. More specifically, protrusion 365 projects from molded portion 363 between pair of movable contacts 391 and 392. Protrusion 365 has hole 366 therein. This configuration maintains elasticity of protrusion 365 even if a contact region between protrusion 365 and stopper 5 increases by increasing a width of protrusion 365.

In electromagnetic relays 1 and 1*a* according to the embodiment, permanent magnet 61 may be arranged such that the N pole and the S pole are reversed. That is, the N pole of permanent magnet 61 may be arranged on the side to exciter coil 21 while the S pole may be arranged on the side to yoke 62. In this case, a direction of a current flowing in the coil is reversed by reversing the polarities of main terminals 33 and 34. This configuration elongates, to the outside, the arc generated between each of movable contacts 391 and 392 and respective one of fixed contacts 31 and 32.

Electromagnetic relays 1 and 1*a* according to the embodiment may not necessarily include movable contacts 391 and 392. In this case, a portion of movable portion 36 of movable spring 35 which faces fixed contact 31 is connected to and disconnected from fixed contact 31, and a portion of movable portion 36 which faces fixed contact 32 is connected to and disconnected from fixed contact 32. That is, movable portion 36 contacts fixed contacts 31 and 32 upon turning on the energizing of exciter coil 21. Movable portion 36 is separated from fixed contacts 31 and 32 upon turning off the energizing of exciter coil 21.

What is claimed is:

1. An electromagnetic relay comprising:

an electromagnet block including an exciter coil and an armature;

a pair of fixed contacts;

a movable spring including a fixed portion and a movable portion, the fixed portion being fixed to the electromagnet block, the movable portion contacting the pair of fixed contacts and being separated from the pair of fixed contacts in response to turning on and off of an energizing of the exciter coil; and a stopper configured to restrict a movement of the movable portion, wherein the armature is fixed to the movable portion and is displaced unitarily with the movable portion, wherein the movable spring is configured to:

upon turning on the energizing of the exciter coil, cause the movable portion to move, by magnetic force, in an approaching direction in which the movable portion approaches the pair of fixed contacts with the fixed portion functioning as a fulcrum, and contact the pair of fixed connection portions; and upon turning off the energizing of the exciter coil, cause the movable portion to be separated, by restoring force, from the pair of fixed contacts in a separating direction in which the movable portion is separated from the pair of fixed contacts, and wherein the stopper is configured to:

upon turning on the energizing of the exciter coil, contact the movable portion and reduce a moving speed of the movable portion in the approaching direction before the movable portion contacts the pair of fixed contacts; and upon turning off the energizing of the exciter coil, contact the armature and reduce the moving speed of the movable portion in the separating direction.

2. The electromagnetic relay of claim 1, wherein the stopper includes a contact portion having elasticity, and wherein the contact portion is configured to:

contact the movable portion upon turning on the energizing of the exciter coil; and contact the armature upon turning off the energizing of the exciter coil.

3. The electromagnetic relay of claim 2, wherein the stopper further includes:

a base portion fixed to the electromagnet block; and an extending portion extending from the base portion, and wherein the contact portion is provided at a tip end of the extending portion.

4. The electromagnetic relay of claim 3, wherein the electromagnet block further includes:

a bobbin including a tubular portion having therein an insertion hole extending in an axial direction, the exciter coil being wound on the tubular portion; and a core inserted into the insertion hole and faces the armature, wherein the core includes:

a shaft portion having a columnar shape, and a flange that is provided at one end of the shaft portion, wherein a through-hole is formed in the base portion of the stopper, and wherein the base portion of the stopper is pinched and fixed between the flange and the bobbin while the shaft portion is inserted into the through-hole.

5. The electromagnetic relay of claim 1, wherein the movable portion of the movable spring includes a protrusion provided between the pair of fixed contacts, and wherein the stopper is configured to, upon turning off the energizing of the exciter coil, cause the movable portion to reduce the moving speed of the movable portion in the approaching direction by contacting the protrusion before the movable portion contacts the pair of fixed contacts.

* * * * *